United States Patent [19]

Classen

[11] Patent Number: 4,925,141

[45] Date of Patent: May 15, 1990

[54] DECK CLIP

[76] Inventor: Mickey Classen, Box 782, Lloydminster, Saskatchewan, Canada, S9V 1C1

[21] Appl. No.: 258,377

[22] Filed: Oct. 17, 1988

[51] Int. Cl.[5] ..... E04B 1/38

[52] U.S. Cl. ..... 248/217.2; 248/217.3; 248/300

[58] Field of Search ..... 248/217.3, 217.2, 300; 52/715, 385, 384, 509

[56] References Cited

U.S. PATENT DOCUMENTS

| | | | |
|---|---|---|---|
| 3,331,180 | 7/1967 | Vissing | 52/715 X |
| 4,223,505 | 9/1980 | Krebel et al. | 52/509 |
| 4,279,111 | 7/1981 | Hacker | 52/715 X |
| 4,448,007 | 5/1984 | Adams | 52/509 X |

FOREIGN PATENT DOCUMENTS

| | | | |
|---|---|---|---|
| 675285 | 12/1963 | Canada | 52/385 |

*Primary Examiner*—Alvin C. Chin-Shue
*Attorney, Agent, or Firm*—Shlesinger & Myers

[57] ABSTRACT

Existing brackets for connecting planks to joists when constructing a deck or the like require a plurality of nails for connecting the bracket to the planks and joists. A relatively simple, one nail deck bracket includes a planar body with prongs extending outwardly from each side thereof for uniformly spacing and interconnecting adjacent planks, and a planar arm extending downwardly from the bottom edge of the body in a plane perpendicular to or otherwise angled with respect to the plane of the body for bearing against one side of the joist, the arm having a hole for receiving a nail for connecting the bracket to the joist. Two arms can be provided at opposite ends of the body for, in effect, straddling the joist.

4 Claims, 3 Drawing Sheets

DECK CLIP

BACKGROUND OF THE INVENTION

This invention relates to a bracket, and in particular to a deck bracket.

A deck bracket is a device for connecting planks to joists for forming a deck or floor. A device of generally the same type as the present invention is described in U.S. Pat. No. 4,620,403, which issued to G. L. Field on Nov. 4, 1986. The Field device, which is called a nailing anchor includes a planar body for positioning between adjacent boards or planks, a pair of tabs extending outwardly from the bottom edge of the body resting on the joist and for supporting the edges of adjacent planks, and a short prong extending outwardly from the top edge of the body in the same direction as one tab for penetrating one of the planks. Holes for receiving nails are provided in the body and in one tab. The anchor is nailed to the joist by a nail extending angularly downwardly through the hole in the body and one edge of one plank. The prong extends into the other plank. A nail is hammered through the hole in the tab into the joist.

While the Field device serves to space the planks from the joists and the planks from each other, it will be appreciate that two nails must be used with each anchor.

The object of the present invention is to overcome problems inherent to the patented device by providing a relatively simple deck bracket, which positions a plank with respect to a joist and uniformly spaces and interconnects planks, and requires one nail only.

BRIEF SUMMARY OF THE INVENTION

Accordingly, the present invention relates to a deck bracket of the type used to mount deck planks on a joist comprising planar body means for mounting on the joist to define a space between adjacent planks supported by the joist; planar arm means extending downwardly from one end of said bodY means in a vertical plane angled with respect to the plane of said body means for engaging one side of the joist, and for receiving a fastener to connect the bracket to the joist; and prong means extending outwardlY from each side of said body means for penetrating a plank, whereby planks can be accurately and firmly mounted on the joist in precise spaced apart relationship determined by the thickness of said body means.

DESCRIPTION OF THE DRAWINGS

The invention will be described in greater detail with reference to the accompanying drawings, which illustrate preferred embodiments of the invention, and wherein.

DESCRIPTION OF THE PREFERRED EMBODIMENT(S)

Figure 1:
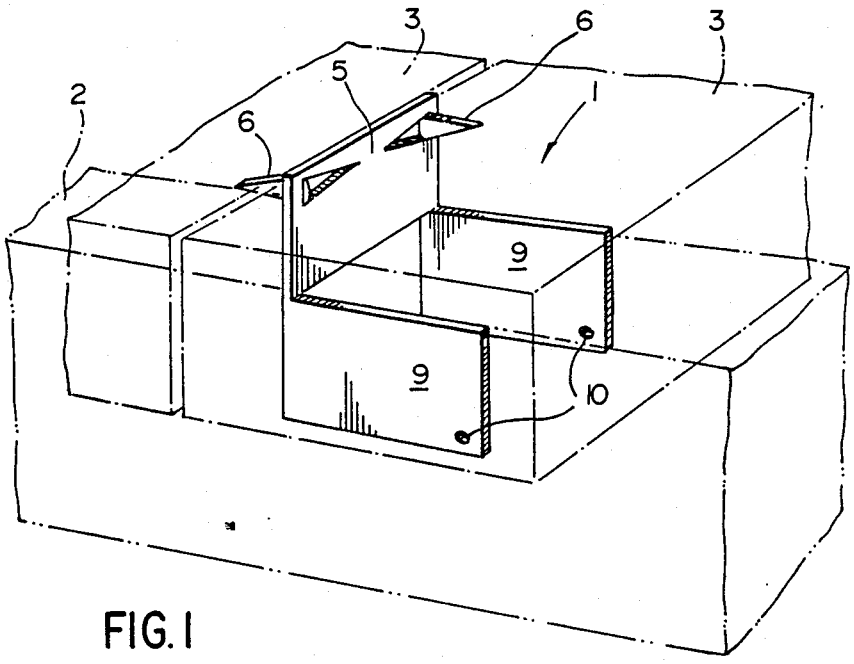
FIG. 1 is a perspective view from above of a deck bracket in accordance with the present invention in a use position.
Figure 2:
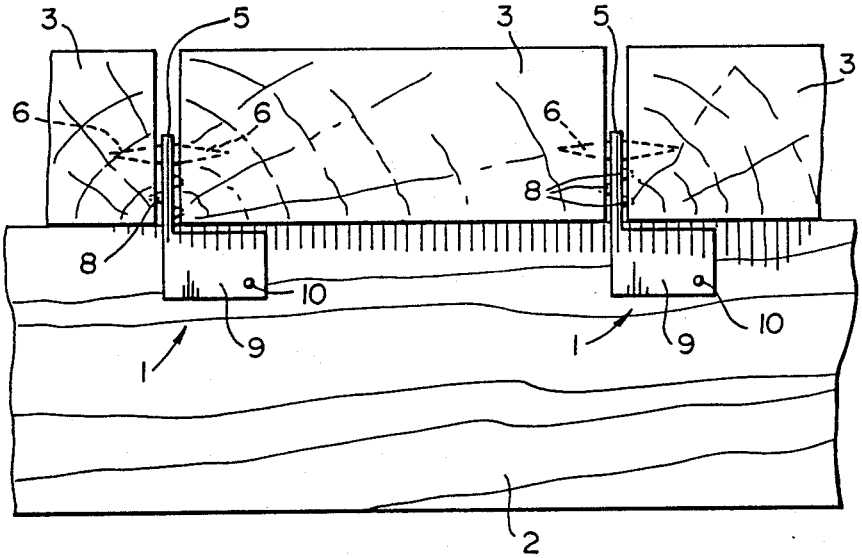
FIG. 2 is an end view of the bracket of FIG. 1 in use.

With reference to FIGS. 1 and 2 the deck bracket or the present invention which is generally indicated at 1, is intended for mounting on a joist 2 for connecting a plurality of planks 3 to the joist when constructing a deck or floor. For simplicity of illustration, the relative dimensions of the joist 2 and planks 3 are not necessarily accurate.

The deck bracket 1 includes a planar, rectangular body 5 for positioning between a pair of adjacent planks 3. The body 5 carries a pair of lanceolate prongs 6, which are integral with the body, being formed by deforming portions of the body 5. The prongs 6 extend outwardly from each side of the body 5 near the edges thereof for penetrating adjacent plan 3. Spacing between adjacent planks 3 is determined by the thickness of the body 5 (FIG. 1) or by projections 8 (FIG. 2) extending outwardly from each side of the body 5.

The bracket 1 is positioned on the joist 2 by means of planar arms 9 extending downwardly from each end of the body 5. The arms 9 occupy planes perpendicular to the plane of the body 5, and prevent movement of the bracket transversely of the joist 2. A hole 10 is provided in each arm 9 for receiving a nail (not shown) to connect the bracket 1 to the joist 2.

In use, with a first plank 3 in position extending across a plurality of joist 2, a bracket 1 is slid along the joist with the arms 9 on each side of the joist until one prong 6 engages the plank 3. The prong is hammered into the plank 3. A second plank 3 is then placed in position on the joist 2 and against the pointed end of the other prong 6. The second plank 3 is then hammered into a fixed position against the body 5.

Figure 3:
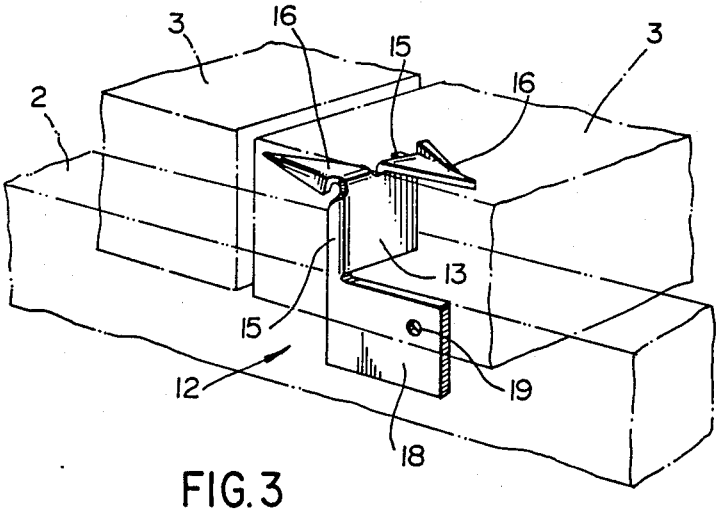
FIG. 3 is a perspective view from above of a second embodiment of the deck bracket of the present invention in use.
Figure 4:
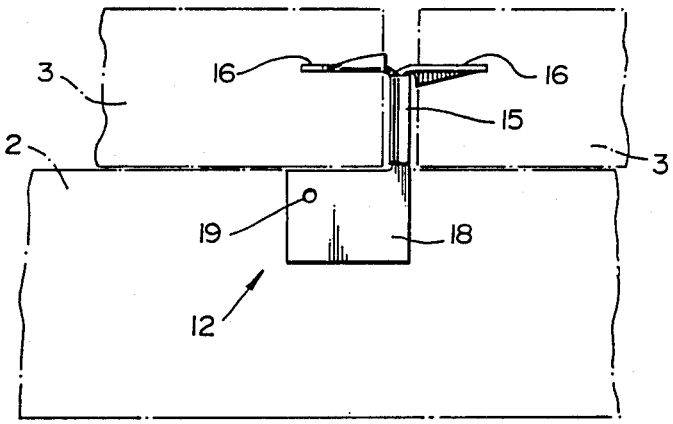
FIG. 4 is an end view of the bracket of FIG. 3.

Referring to FIGS. 3 and 4, a second embodiment of the bracket, which is generally indicated at 12 includes a planar rectangular body 13, with the ends thereof bent perpendicular to the body to define flanges 15, which determine the spacing between adjacent planks 3. A pair of lanceolate prongs 16, which are intergral with the top edge of the body 13, extend outwardly from opposite sides of the body for penetrating adjacent planks 3.

The bracket 12 is positioned on a joist 2 by means of a planar arm 18 extending downwardly from one end of the body 13. Like the arms 9, the arm 18 occupies a plane perpendicular to the plane of the body 13. A hole 19 is provided in the arm 18 for receiving a nail, which connects the bracket 12 to the joist 2.

Figure 5:
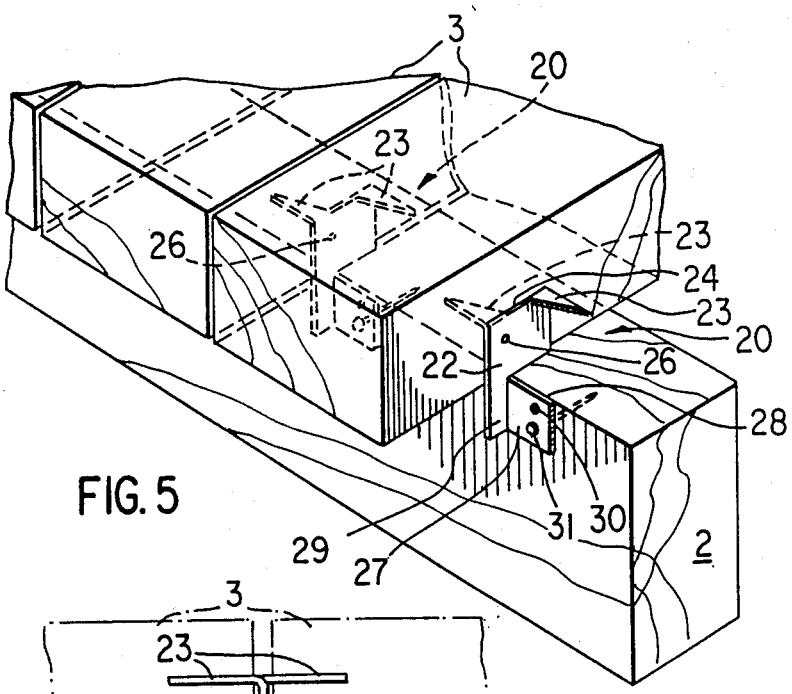
FIG. 5 is a perspective view from above of two deck brackets in the use position.
Figure 6:
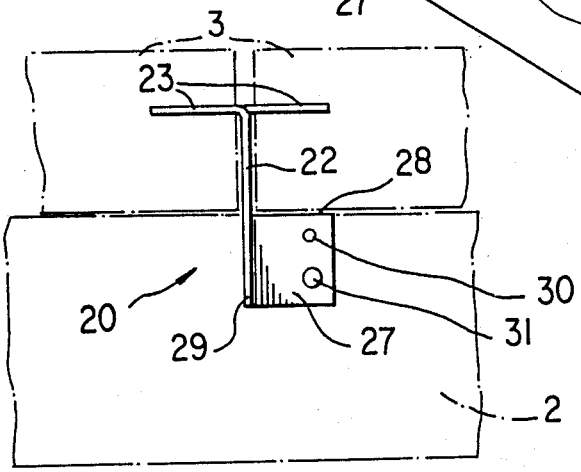
FIG. 6 is an end view of the 16 bracket of FIG. 5 in 16 use position.

Referring to FIGS. 5 and 6, the third embodiment of the bracket, which is generally indicated at 20 includes a planar, rectangular body 22. A prong 23 extends outwardly from each side of the body 22 at the top edge 24 thereof. The prongs 23 are integral with the body 22 and extend outwardly from the top corners thereof for penetrating adjacent planks 3. Spacing between adjacent planks 3 is determined by the thickness of the body 22. A hole 26 is provided in the body 22 for receiving a nail (not shown) for augmenting the connection between the bracket and one of the planks 3.

The bracket 20 is positioned on a joist 2 by means of a planar arm 27 extending outwardly form one side of the body 22 and by a shoulder 28. The arm 27 and the shoulder 28 are formed by cutting a plate used to produce the body 22, and bending the thus formed arm 27 perpendicular to the body. The remaining bottom end 29 of the body 22 abuts the joist 2 to prevent movement of the bracket 20 transversely of the joist. Holes 30 are provided in the arm 27 for receiving nails 31 (one shown) to connect the arm to the joist 2.

The body 5 or 13 with or without the projections 8 and flanges 15 accurately defines the spacing between adjacent planks 3. The arms 9 or 18 stabilize the bracket with respect to the joist 2, and prevent sliding of the planks 3 transversely of the joist 2. It will be appreciated that the angle between the body 5 or 13 and the arms 9 or 18 can be 90° or less. If the planks 3 are to be angled with respect to the joist 2, the arms 9 or 18 must be angled with respect to the body 5 or 13, respectively. In the appended claims, the term "angled" is intended to means 90° or an acute angle.

The use of the bracket 20 is the same as that described with respect to the bracket of FIGS. 3 and 4. As in the case of the other embodiments of the invention, the body 22 accurately defines the spacing between adjacent planks 3, and the arm 27 stabilizes the bracket with respect to the joist 2.

What is claimed is:

1. A deck bracket of the type used to mount deck planks on a joist comprising:

(a) planar body means, having ends and a top edge, for mounting on the joist to define a space between adjacent planks supported by the joist;

(b) planar arm means extending downwardly from one end of said body means in a vertical plane angled with respect to the plane of said body means for engaging one side of the joist;

(c) said planar arm means forming a rectangular flag extending in one direction along the joist away from said planar body means;

(d) said planar arm means including a hole for receiving a fastener to connect the bracket to the joist;

(e) said hole being located in said planar arm means and spaced horizontally from said planar body means;

(f) prong means extending outwardly from each side of said planar body means for penetrating a plank; and (g) whereby, the planks can be accurately and firmly mounted on the joist in a precise spaced apart relationship determined by the thickness of said body means.

(h) spacer means on said body means for bearing against adjacent planks to determine the spacing therebetween, said spacer means includes flanges extending outwardly from the ends of said body means.

2. A deck bracket according to claim 1, wherein said prong means includes lanceolate lugs integral with said body means and extending outwardly therefrom.

3. A deck bracket according to claim 1, where said prong means includes lanceolate lugs integral with the top edge of said body means and extending outwardly from each side thereof for penetrating adjacent beams.

4. A deck bracket according to claim 1, wherein said body means is integral with said arm means and prong means, said body means including a plate, a planar portion of said plate perpendicular to the remainder thereof defining said arm means, said prong means including planar, lanceolate lugs integral with and extending outwardly from each side of the top edge of said body means for penetrating adjacent beams.

* * * * *